United States Patent [19]

Sauder

[11] 4,089,289

[45] May 16, 1978

[54] MOVABLE BOAT PROPULSION APPARATUS

[76] Inventor: Kenneth D. Sauder, 1861 Brentwood Dr., Clearwater, Fla. 33516

[21] Appl. No.: 736,116

[22] Filed: Oct. 27, 1976

[51] Int. Cl.[2] ..... B63H 5/12

[52] U.S. Cl. ..... 115/41 HT; 115/41 R

[58] Field of Search ..... 115/41 R, 41 HT, 35

[56] References Cited

U.S. PATENT DOCUMENTS

| | | | |
|---|---|---|---|
| 2,265,079 | 12/1941 | Mettair | 115/41 R |
| 2,856,883 | 10/1958 | Baker | 115/41 R |
| 2,956,536 | 10/1960 | Kilvington | 115/41 R |
| 3,469,558 | 9/1969 | Puretic | 115/41 R |

FOREIGN PATENT DOCUMENTS

| | | | |
|---|---|---|---|
| 1,114,585 | 4/1956 | France | 115/41 R |

*Primary Examiner*—Trygve M. Blix
*Assistant Examiner*—Stuart M. Goldstein
*Attorney, Agent, or Firm*—Stein & Frijouf

[57] ABSTRACT

A movable boat propulsion apparatus for use with an inboard drive comprising a drive assembly disposed within a pivotally mounted housing coupled at one end to the drive by a universal joint and coupled at the opposite end to a propeller mounted on a substantially vertical strut by a second universal joint such that the entire boat propulsion apparatus is movable in the vertical plane relative to the boat hull. The apparatus may also include a control coupled to the strut to adjust the height and angular orientation of the propeller in the vertical plane relative to the boat hull.

10 Claims, 2 Drawing Figures

MOVABLE BOAT PROPULSION APPARATUS

BACKGROUND OF THE INVENTION 1. Field of the Invention

A movable boat propulsion apparatus comprising a drive assembly interconnected to an inboard drive means and propeller means by a first and second universal joint respectively.

2. Description of the Prior Art

A number of tiltable marine propulsion systems have been developed such that the propeller housing is freely tiltable should the propeller means impinge on an obstruction such as bottom or submerged objects to prevent destruction of the propeller. In addition, the propeller is generally tilted up for docking, shallow water trolling and the like. Such tiltable systems are almost universally restricted to use with outboard motors.

A problem which exists with tilting of inboard drive means is the excessive thrust or torque generated when the propeller is in a partially tilted position. This can exert a destructive force on the motor and drive assembly unless appropriate provision is made to safeguard against such emergency conditions. Unfortunately, most safeguard systems include various expensive warning and control systems to prevent an overload condition.

Most existing tilt or lift mechanisms include motorized drive-lift mechanisms with pulley and cable arrangements which are expensive to manufacture and operate. In addition, these tilt systems generally vary the horizontal thrust component when tilted thereby reducing the effective power of the entire propulsion system.

Thus, there is a need for an improved marine drive tilting mechanism particularly for inboard drives including tilting means with safety features inherent in the tilting which is relatively inexpensive to manufacture, dependable, and economical to operate.

SUMMARY OF THE INVENTION

The invention relates to a movable boat propulsion apparatus. More specifically, the boat propulsion apparatus comprises a drive assembly interconnecting a propeller means to an inboard drive means to permit vertical movement of the propeller means relative to the boat hull.

The drive assembly comprises an elongated drive shaft enclosed within a housing pivotally attached to the bottom of the hull. The elongated drive shaft terminates at each end with a first and second coupling means. Each coupling means comprises a universal joint. The upper portion of the housing is partially disposed within a channel means formed in the bottom of the hull. The propeller means is rotatably mounted on the rear portion of the housing. A substantially vertical strut means is attached to the housing and the upper portion of the strut means is interconnected to the rear portion of the hull by a strut control means, preferably comprising a hydraulic piston/cylinder combination.

An alternate embodiment further includes a directional thrust control means enclosed within the housing to move the strut means and propeller means in the vertical plane relative to the hull. In addition, a second directional control means interconnects the strut control means and rear of the hull. Coordination of the first and second directional control means permits directional control of the thrust and height of the propeller means relative to the hull as more fully described hereinafter.

In operation, the strut means is substantially vertical with strut control means fully extended. In this position the propeller means is substantially vertical. The propeller means is driven through the drive assembly by the inboard drive means. Should the strut means strike the bottom of the water or a submerged object, the strut means will rotate rearwardly and upwardly causing housing to move upward further into the channel means. Since the drive assembly is operatively coupled at each end by a universal joint, the drive assembly and propeller means continue to operate without overloading or over-torqueing the apparatus despite the angular orientations of the propeller means relative to the hull. The upward movement of the strut means is controlled by the piston/cylinder combination. Similarly, the downward movement of the strut means is also controlled as it returns to the vertical position once the impinging force is removed. It can thus be seen that the propeller and drive assembly continue to operate normally despite striking the bottom or a submerged object.

The alternate embodiment operates similarly to the embodiment described above with several additional elements. Specifically, extension and retraction of the first directional control means within the housing changes the angular orientation of the propeller means relative to the hull as well as the distance of the propeller means below the hull. By adjusting the second directional control means relative to the hull the angular orientation of the propeller means relative to the hull may be changed. Thus, by coordinating the extension and retraction of the first and second directional control means the depth of the propeller means may be adjusted while maintaining the propeller means in a substantially vertical plane. In addition, it should be noted that since the housing is movable upwardly into the channel, the apparatus may be adjusted to operate in very shallow water without losing any thrust vector.

The invention accordingly comprises the features of construction, combination of elements and arrangement of parts which will be exemplified in the construction hereinafter set forth, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings in which.

Similar reference characters referr to similar parts throughout the several views of the drawings.

DETAILED DESCRIPTION

Figure 1:
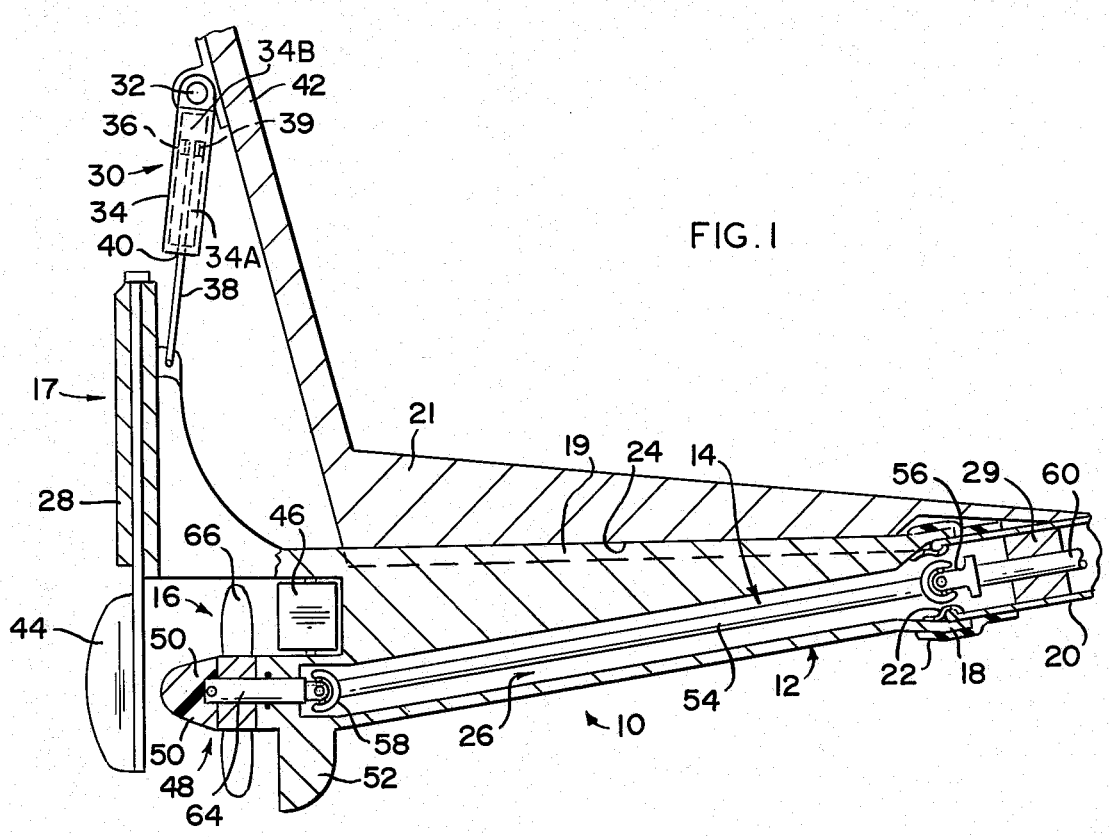
FIG. 1 is a cross-sectional side view of the movable boat propulsion apparatus.

As shown in FIG. 1, the boat propulsion apparatus generally indicated as 10 comprises a drive housing means 12, interconnecting drive means 14, propeller means 16 and strut means 17.

The inner portion 18 of housing means 12 is movably coupled to mount 20 by flexible boot 22. The upper portion 19 of housing means 12 is normally disposed within channel 24 of the hull 21 as shown in FIG. 1. Channel 26 extends the length of housing means 12 to operatively support the drive means 14 as more fully described hereinafter. The strut means 17 is attached to the rear portion of housing means 12 which extends upward to engage attachment means or strut control means generally indicated as 30 secured to the hull by fastener means 32. The attachment means 30 comprises a buffer means including a first or lower portion 34A of a cylinder 34, piston means 36 and interconnecting member 38 movably attached to rearward portion 28. Interconnecting member 38 extends through aperture 40 and is fixedly attached to piston 36 including a plurality of apertures 39 formed therein. The upper or second portion 34B of cylinder 34 is pivotally attached to the rear 42 of hull 21 by fastener means 32.

A primary rudder means 44 is fixedly secured to the lower portion of strut means 17. A secondary rudder means 46 is secured to the rear portion of housing means 12. Propeller mount 48 comprising propeller support means 50 and propeller guard means 52 depend from the rear portion of housing means 12.

The drive means 14 includes drive shaft means 54 and coupling means 56 and 58 comprising universal joints formed at opposite ends thereof. The inner universal joint 56 is attached directly to motor shaft 60. As shown at 29, the universal joint 56 may be sealed. The outer universal joint 58 is coupled to the propeller means 16. The propeller means 16 comprises propeller shaft 64 rotatably mounted within propeller support means 50 and propeller 66 attached thereto. Since the drive shaft means 54 is enclosed within channel 26 the universal joints 56 and 58 may be constantly lubricated by introducing a lubricant into channel 26.

Figure 2:
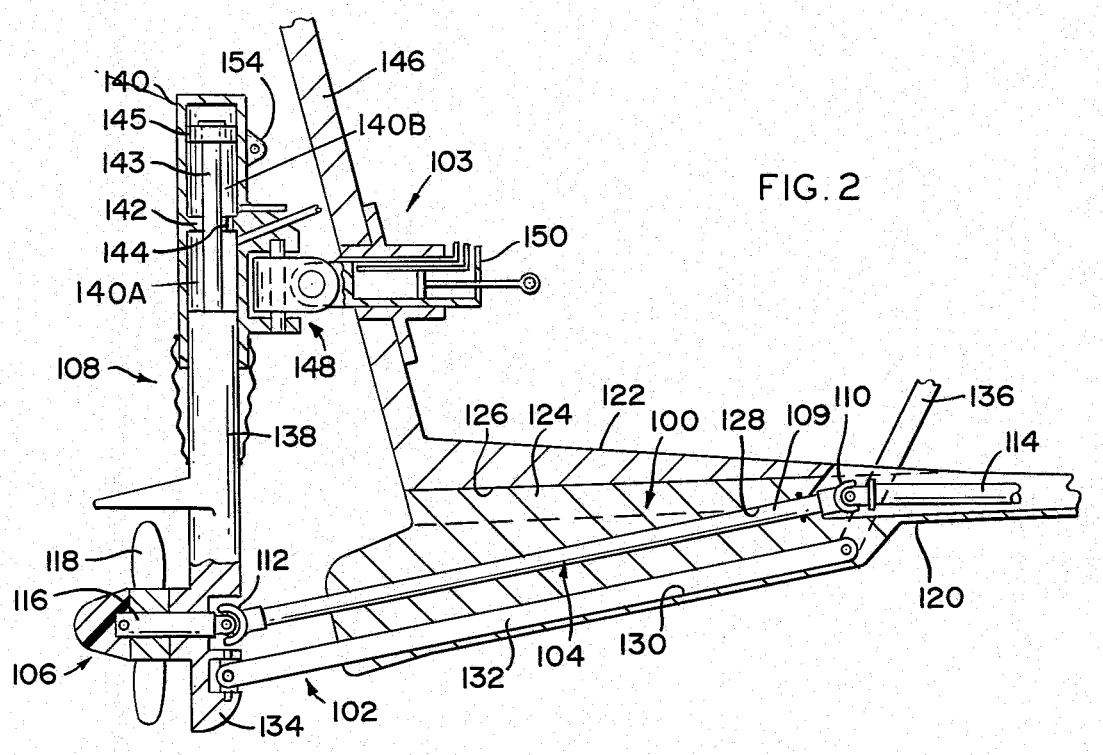
FIG. 2 is a cross-sectional side view of an alternate embodiment of the movable boat propulsion apparatus.

FIG. 2 shows an alternate embodiment including a directional thrust control means. This alternate embodiment includes drive housing means 100, directional thrust control means 102, and 103, interconnecting drive means 104, propeller means 106 and strut means 108.

The interconnecting drive means 104, includes drive shaft means 109 and coupling means 110 and 112 comprising universal joints 110 and 112 formed at opposite ends thereof. Inner universal joint 110 is attached directly to motor shaft 114 while the outer universal joint 112 is attached to propeller means 106. Propeller means 106 comprises propeller shaft 116 and propeller 118.

The inner portion 120 of housing means 100 is movably coupled to the hull 122. The upper portion 124 is partially disposed within channel 126 of the hull 122. A first and a second channel 128 and 130 respectively extend substantially the length of housing means 100. The first or upper channel 128 operatively supports shaft means 109 while the second or lower channel 130 operatively supports directional thrust control means 102.

The directional thrust control means 102 comprises control shaft 132 coupled to the lower portion of strut means 108 at its outer end and to control lever 136 at its inner end. A propeller guard 134 is formed on the lower portion of strut means 108.

Strut means 108 comprises a lower cylindrical body 138 and upper hollow cylinder 140. The cylinder 140 includes a first and a second cylinder portion 140A and 140B. A support member 142 including aperture 144 formed therein is arranged within cylinder 140 between the first and second cylinder portions 140A and 140B. An elongated interconnecting member 143 including enlarged portion 145 interconnects body 138 and cylinder 140. Cylinder 140 is connected to the rear 146 of hull 122 by second directional thrust control means 103. Control means 103 comprises mount 148 pivotally coupled to adjustment means 150.

In operation, shown in FIG. 1 strut means 28 is substantially vertical with attachment means 39 fully extended. In this position propeller 66, interconnected to motor means (not shown) by drive means 14, is powered to drive the boat. In the event guard 52 strikes the bottom of the water or a submerged object, strut means 28 will rotate rearwardly and upwardly causing housing means 12 to move upwardly into channel 24. Since the drive means 14 is connected at each end by universal joints 56 and 58, the entire propulsion apparatus 10 will continue to operate. The hydraulic attachment means 30 buffers the upward movement of the entire apparatus. The flow of fluid between the first and second cylinder portions 34A and 34B through apertures 39 damps the movement of the housing means 12. Once the impinging force is removed, housing means 12 rotates downward, the fluid in cylinder 34 controlling the rate of return. Since the drive shaft means 54 and universal joints 56 and 58 are contained within channel 26, lubricant may be enclosed therein to reduce wear.

The alternate embodiment shown in FIG. 2 operates similarly to the preferred embodiment of FIG. 1. Fluid flow through aperture 144 between the first and second cylinder portions 140A and 140B damps the movement of housing means 100. The control arm 102 may be extended and retracted relative to housing means 100 by lever means 136 to rotate strut means 108 to change direction of thrust. In addition, the strut means 108 may be tilted by movement of control means 103. Stop 154 prevents the upper portion of strut means 108 from striking the rear protion 146 of hull 122. Thus, by coordinating the extension and retraction of the first and second directional control means the depth of the propeller means 106 may be adjusted while maintaining the propeller means 106 in a substantially vertical plane. In addition, it should be noted that since the housing 100 is movable upwardly into the channel 126 the apparatus may be adjusted to operate in very shallow water without losing any thrust vector.

It will thus be seen that the objects set forth above, among those made apparent from the preceding description, are efficiently attained and, since certain changes may be made in the above construction without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described, what is claimed is:

1. A boat propulsion drive system, for use primarily in combination with a boat power means and a boat, having a transom, said boat propulsion drive system comprising: a drive assembly housing pivotally attached to the boat hull; and drive assembly means operatively mounted to said drive assembly housing, said drive assembly housing including strut means to interconnect the rear portion of said drive assembly housing to said boat hull, propeller means mounted on said drive assembly housing, said drive assembly means including flexible coupling means to interconnect said drive assembly means to said propeller means and the boat power means, said drive assembly housing being movable relative to said boat hull, whereby said drive assembly means drives said propeller means at a substantially constant torque, said strut control means comprising an enclosed cylinder having a piston disposed therein, said piston disposed in said enclosed cylinder; said cylinder having a first and a second cylinder portion, aperture means interconnecting said first and second portions of said enclosed cylinder; said cylinder containing a fluid to control rate of movement of said piston relative to said cylinder in accordance with the fluid flow through said aperture means, and said cylinder and pistion being mounted between said rear portion of said drive assembly and the transom of the boat.

2. The boat propulsion drive system of claim 1 wherein said drive assembly housing is at least partially enclosed within a channel formed on said boat.

3. The boat propulsion drive system of claim 1 wherein said drive assembly housing includes an elongated channel formed therein and said drive assembly means comprises an elongated drive shaft disposed within said elongated channel.

4. The boat propulsion drive system of claim 3 wherein said flexible coupling means comprises a universal joint formed at each end of said elongated drive shaft.

5. The boat propulsion drive system of claim 1 further including a strut control means attached to said boat hull and moveably interconnecting said strut means to said boat hull to control the movement of said drive assembly housing relative to said boat hull.

6. The boat propulsion drive system of claim 1 further including first directional thrust control means attached to said drive assembly housing to vary the thrust vector of said propeller means.

7. The boat propulsion drive system of claim 6 wherein said drive assembly housing includes a second elongated channel formed therein and said first directional thrust control means comprises an elongated directional control shaft attached to said strut means.

8. The boat propulsion drive system of claim 6 further including second directional thrust control means interconnecting said strut means and said boat hull, said first and second directional thrust control means cooperating to control the depth of said propeller means relative to said boat hull.

9. The boat propulsion drive system of claim 8 wherein said second directional thrust control means comprises an adjustable member mounted on said boat hull, said adjustable member pivotally connected to the upper portion of said strut means.

10. A boat propulsion drive system, for use primarily in combination with a boat power means and a boat, said boat propulsion drive system comprising: a drive assembly housing pivotally attached to the boat hull; drive assembly means operatively mounted to said drive assembly housing, said drive assembly housing including strut means to interconnect the rear portion of said drive assembly housing to said boat hull, propeller means mounted on said drive assembly housing, said drive assembly means including flexible coupling means to interconnect said drive assembly means to said propeller means and the boat power means, said drive assembly housing being movable relative to said boat hull, whereby said drive assembly means drives said propeller means at a substantially constant torque, first directional thrust control means attached to said drive assembly housing to vary the thrust vector of said propeller means, said drive assembly housing including an elongated channel formed therein, and said first directional thrust control means comprising an elongated directional control shaft attached to said strut means.

* * * * *